US008690544B2

(12) United States Patent
Ono et al.

(10) Patent No.: US 8,690,544 B2
(45) Date of Patent: Apr. 8, 2014

(54) OIL PUMP

(75) Inventors: Hisashi Ono, Okazaki (JP); Shinji Kazaoka, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/878,496

(22) PCT Filed: Dec. 6, 2011

(86) PCT No.: PCT/JP2011/078188

§ 371 (c)(1),
(2), (4) Date: Apr. 9, 2013

(87) PCT Pub. No.: WO2012/086408

PCT Pub. Date: Jun. 28, 2012

(65) Prior Publication Data

US 2013/0209302 A1 Aug. 15, 2013

(30) Foreign Application Priority Data

Dec. 21, 2010 (JP) ..... 2010-284695
Feb. 23, 2011 (JP) ..... 2011-037481

(51) Int. Cl.
*F04B 49/00* (2006.01)
*F04C 14/22* (2006.01)

(52) U.S. Cl.
CPC ..... *F04C 14/226* (2013.01)
USPC ..... 417/213; 417/220; 418/30

(58) Field of Classification Search
USPC ..... 417/213, 220; 418/30
See application file for complete search history.

(56) References Cited

U.S. PATENT DOCUMENTS 5,797,732 A * 8/1998 Watanabe et al. ..... 417/310
7,011,069 B2 * 3/2006 Ono et al. ..... 123/196 R (Continued)

FOREIGN PATENT DOCUMENTS

DE 10 2006 059 965 A1 6/2008
JP 63-001781 A 1/1988

(Continued)

OTHER PUBLICATIONS

International Search Report (PCT/ISA/210) issued on Feb. 21, 2012, by the Japanese Patent Office as the International Searching Authority for International Application No. PCT/JP2011/078188.

(Continued)

*Primary Examiner* — Charles Freay
*Assistant Examiner* — Joseph Herrmann
(74) *Attorney, Agent, or Firm* — Buchanan Ingersoll & Rooney PC

(57) ABSTRACT

An oil pump includes a capacity adjustment mechanism that changes the pump capacity by moving a tubular body in a tube radial direction, with a pump chamber formed between the tubular body and an outer circumference side of a rotor, a first spring biasing the tubular body in a direction in which pump capacity increases, a control valve that converts oil pressure of the oil pump into control pressure and causes the control pressure to act on the capacity adjustment mechanism, and a second spring biasing a valve body in order to set the control pressure in the control valve. The relationship of the biasing forces of the first and second springs is set so that pump capacity is set to maximum when the engine rotational speed is less than a predetermined value, and so that pump capacity is reduced when the engine rotational speed exceeds a predetermined value.

7 Claims, 5 Drawing Sheets

(56) References Cited

U.S. PATENT DOCUMENTS

| | | | | |
|---|---|---|---|---|
| 7,794,217 | B2 | 9/2010 | Williamson et al. | |
| 2008/0069704 | A1 | 3/2008 | Armenio et al. | |
| 2008/0308062 | A1* | 12/2008 | Morita et al. | 123/196 R |
| 2010/0080724 | A1 | 4/2010 | Jannausch et al. | |
| 2010/0226799 | A1 | 9/2010 | Watanabe et al. | |
| 2011/0014078 | A1 | 1/2011 | Ono et al. | |

FOREIGN PATENT DOCUMENTS

| | | | |
|---|---|---|---|
| JP | 2005-140022 | A | 6/2005 |
| JP | 2008-524500 | A | 7/2008 |
| JP | 2009-074481 | A | 4/2009 |
| JP | 2010-502894 | A | 1/2010 |
| JP | 2010-209718 | A | 9/2010 |
| JP | 2010-209812 | A | 9/2010 |
| WO | WO 2010/013625 | A1 | 4/2010 |

OTHER PUBLICATIONS

Written Opinion (PCT/ISA/237) issued on Feb. 21, 2012, by the Japanese Patent Office as the International Searching Authority for International Application No. PCT/JP2011/078188.

International Preliminary Report on Patentability (PCT/IB/373) issued on Jul. 2, 2013, by the Japanese Patent Office as the International Searching Authority for International Application No. PCT/JP2011/078188 (5 pgs).

* cited by examiner

OIL PUMP

TECHNICAL FIELD

The present invention relates to oil pumps, and more particularly to improving variable-capacity oil pumps.

BACKGROUND ART

As an oil pump configured as mentioned above, Patent Document 1 discloses a configuration that has a drive gear (exemplary rotor) that is rotationally driven by an engine and an internal tooth driven gear (exemplary tubular body) that meshes with the drive gear, and is provided with a single suction port, two discharge ports, and an oil pressure control valve that controls the flow of oil from the two discharge ports.

In Patent Document 1, the oil pressure control valve is provided with a valve body that controls the flow of hydraulic oil from one of the discharge ports, and a spring that causes a biasing force to act on the valve body. With this oil pump, when the engine rotational speed is low, hydraulic oil from the two discharge ports is merged and pumped out. Then, when the rotational speed of the engine increases, excess supply of hydraulic oil is suppressed by returning some of the hydraulic oil from one of the discharge ports to the suction port using the valve body, and merging the remainder with the hydraulic oil from the other discharge port.

In Patent Document 1, oil can thus be supplied with the required characteristics by combining an oil pressure control valve with an internal gear pump having two discharge ports.

Patent Document 2 shows an internal gear pump in which an inner rotor that has outer teeth and is driven around a drive rotation axis and an outer rotor (exemplary tubular body) that has inner teeth that mesh with the inner rotor (exemplary rotor) in an eccentric state and rotates around the rotation center are provided inside a casing. An adjustment ring is provided that causes the rotation center of the outer rotor to revolve about the drive rotation axis in a state where the inner rotor meshes with the outer rotor, and the pump capacity can be changed by causing the outer rotor to revolve with operation of the adjustment ring.

In Patent Document 2, a coil spring is provided that biases the adjustment ring to a predetermined position, and an oil pressure hydraulic system that causes the adjustment ring to revolve against the biasing force of the coil spring, and the capacity of the oil pump can be changed by switching between a state of supplying hydraulic oil to the oil pressure hydraulic system via an electromagnetic valve and a state of allowing hydraulic oil to flow out.

Patent Documents 3 and 4 describe variable-capacity vane oil pumps in which the pump capacity is changed by oscillating a cam ring (exemplary tubular body).

The oil pump described in Patent Document 3 is provided with a first pressure chamber that applies an oscillating force to the cam ring such that the amount of eccentricity of the cam ring relative to the revolution axis of the rotor decreases, a second pressure chamber that applies an oscillating force to the cam ring such that the amount of eccentricity increases, and an electromagnetic valve that selectively supplies hydraulic fluid to the second pressure chamber.

The oil pump described in Patent Document 4 is provided with a first control chamber that causes a force that reduces the pump capacity to act on the cam ring, a second control chamber that causes a force that increases the pump capacity to act on the cam ring, and an electromagnetic valve that selectively supplies hydraulic fluid to the second control chamber.

CITATION LIST

Patent Documents

Patent Document 1: JP 2005-140022A
Patent Document 2: WO 2010/013625
Patent Document 3: JP 2010-209718A
Patent Document 4: JP 2008-524500A

SUMMARY OF INVENTION

When constituting an oil pump for supplying oil to an engine lubricating system or the like, a configuration, as described in Patent Document 1, in which the required amount of oil is supplied when the rotational speed of the engine is low, supply of excess oil is suppressed when the rotational speed of the engine increases, and the amount of oil is increased with the aim of cooling the engine when the rotational speed of the engine further increases is also useful.

With an oil pump for controlling oil pumped out from two discharge ports as described in Patent Document 1, oil can be supplied effectively in the case where oil from the two discharge ports is merged. However, there is room for improvement, since a pointless and unnecessary flow of oil occurs when returning some or all of the oil from one of the discharge ports to the suction side, resulting not only wasted energy but also leading to a rise in oil temperature.

Also, with the oil pump described in Patent Document 2, there is room for improvement, since the electromagnetic valve has difficulty operating properly when the oil is highly viscous at low temperatures. In particular, in the case where an electromagnetic valve is provided, there is room for improvement since electromagnetic valves are costly, and, moreover, an electrical control system for controlling the electromagnetic valve is required, leading to a rise in cost.

With the vane oil pumps described in Patent Document 3 and 4, there is room for improvement since electromagnetic valves are costly and an electrical control system for controlling the electromagnetic valve is also required, leading to a rise in manufacturing cost, in addition to the possibility of the electromagnetic valve having difficult operating properly when the oil is highly viscous at low temperatures, similarly to the oil pump described in Patent Document 2.

An object of the present invention is to configure an oil pump at low cost that realizes highly reliable operation even at low temperatures, without a pointless flow of oil.

In a first characteristic configuration of the present invention, an oil pump includes a rotor that is rotationally driven by an engine, a tubular body that forms a pump chamber between the tubular body and an outer circumference side of the rotor, a casing that houses the rotor and the tubular body, a suction port and a discharge port that are formed in the casing, a pump mechanism that causes oil suctioned into the pump chamber from the suction port to be discharged from the discharge port following rotation of the rotor, a capacity adjustment mechanism that changes a pump capacity by moving the tubular body in a tube radial direction relative to the rotor, a control valve that converts oil pressure from the discharge port into control pressure, and a control oil passage that is capable of moving the tubular body in the tube radial direction by causing the control pressure from the control valve to act on the capacity adjustment mechanism, the capacity adjustment mechanism has a configuration that moves the tubular body in a direction in which pump capacity decreases, as the control pressure increases, the control valve maintains the control oil passage in an open state, in a pressure region in which the oil pressure is less than a first control value and in a pressure region in which the oil pressure reaches a second control value that exceeds the first control value, and the capacity adjustment mechanism, in a case where the control pressure is less than the first control value, increases an oil discharge amount at a first gradient following an increase in engine rotational speed by setting the pump capacity to maximum, and, in a case where the control pressure exceeds the first control value, increases the oil discharge amount at a second gradient that is less than the first gradient following an increase in engine rotational speed in a state where the pump capacity is reduced by moving the tubular body in the direction in which pump capacity decreases.

The oil pump of this configuration causes control pressure to act on the capacity adjustment mechanism, without being affected by the viscosity of the oil, by using a control valve that is operated by the oil pressure of the discharge port, enabling the capacity adjustment mechanism to operate properly. The control valve maintains the control oil passage in an open state in a pressure region in which the oil pressure is less than a first control value and in a pressure region in which the oil pressure reaches a second control value that exceeds the first control value. When the control pressure is less than the first control value, the capacity adjustment mechanism thus maintains the pump capacity at a high value, and increases the discharge amount of oil at a first gradient following an increase in engine rotational speed. Also, when the control pressure exceeds the first control value, the capacity adjustment mechanism increases the discharge amount of oil at a second gradient that is less than the first gradient, following an increase in engine rotational speed, by switching to a smaller pump capacity. When the control pressure reaches the first control value while supplying a sufficient amount of oil even in the low-speed state, an unnecessary amount of oil will thereby not be supplied even if engine rotational speed increases.

According to an oil pump of this configuration, an oil pump that realizes reliable operation even at low temperatures without a pointless flow of oil can be manufactured at low cost.

In a second characteristic configuration of the present invention, the control valve, in a case where the oil pressure rises in a pressure region from the second control value up to a third control value that exceeds the second control value, operates to decrease the control pressure by narrowing the control oil passage as the oil pressure rises, and the capacity adjustment mechanism decreases the reduction in pump capacity by reducing or stopping movement of the tubular body in the direction in which pump capacity decreases, and increases the oil discharge amount at a third gradient that is greater than the second gradient following an increase in engine rotational speed.

With this configuration, if the oil pressure exceeds the second control value, the control valve narrows the control oil passage as oil pressure rises, and following this, the capacity adjustment mechanism reduces or stops movement of the tubular body in the direction in which pump capacity decreases, thereby decreasing the reduction in pump capacity. Because the oil discharge amount is increased at a third gradient that is greater than the second gradient following an increase in engine rotational speed, the required amount of oil can be supplied.

In a third characteristic configuration of the present invention, the control valve, in a case where the oil pressure rises to a value exceeding the third control value, operates to a position that blocks a site of the control oil passage on which the oil pressure acts, and that brings a site of the control oil passage on the capacity adjustment mechanism side into communication with a low pressure side, and the capacity adjustment mechanism increases the pump capacity by moving the tubular body in a direction in which pump capacity increases, following a decrease in the control pressure.

With this configuration, since the control pressure acting on the capacity adjustment mechanism drops in the case where the oil pressure rises to exceed the third control value, the capacity adjustment mechanism increases the pump capacity. Sufficient oil for also cooling the engine can thereby be supplied following a further increase in engine rotational speed.

In a fourth characteristic configuration of the present invention, the capacity adjustment mechanism has a first biasing means for biasing the tubular body to a side on which pump capacity increases, and a pressure receiving portion that moves the tubular body toward a side on which pump capacity decreases against a biasing force of the first biasing means by receiving the control pressure, the control valve has a valve body that is displaced by the oil pressure that acts from the discharge port, and a second biasing means for causing a biasing force to act on the valve body in a direction against the oil pressure, and the biasing force of the second biasing means is set such that the valve body maintains the control oil passage in an open state in a case where the oil pressure is less than the second control value, and the biasing force of the first biasing means is set such that the tubular body moves toward the side on which pump capacity increases in a case where the control pressure exceeds the second control value.

With this configuration, the required amount of oil can be supplied, by controlling the valve body and the operation of the capacity adjustment mechanism in response to the engine rotational speed through setting of the relationship of the biasing force of the first biasing means for biasing the tubular body to the side on which pump capacity increases and the biasing force of the second biasing means for biasing the valve body of the control valve to an open state, and moving the tubular body with the control pressure from the control valve.

In a fifth characteristic configuration of the present invention, an oil pressure action space in which the oil pressure from the discharge port acts on an outer circumferential portion of the tubular body is formed inside the casing, and in a region in which the oil pressure exceeds the third control value, the biasing force of the first biasing means is set such that the tubular body is moved toward the side on which pump capacity decreases by the oil pressure that acts on the outer circumferential portion of the tubular body from the oil pressure action space.

With this configuration, in a pressure region in which the oil pressure of the discharge port exceeds the third control value, the oil pressure of the discharge port acts on the tubular body irrespective of the state of the control valve, and causes the tubular body to move toward the side on which pump capacity decreases, enabling the pump capacity to be reduced and excess supply of oil to be suppressed.

In a sixth characteristic configuration of the present invention, the rotor is an inner rotor that has a plurality of outer teeth, the tubular body is an outer rotor that has an annular shape with a plurality of inner teeth that mesh with the outer teeth, and that is rotatable around a tube axis that is eccentric relative to a rotation axis of the inner rotor, the pump chamber is formed between the inner teeth and the outer teeth, the capacity adjustment mechanism is capable of changing the pump capacity by causing the outer rotor to revolve about the rotation axis in a state where the inner teeth mesh with the outer teeth, the capacity adjustment mechanism has an adjustment ring that rotatably supports the outer rotor, and realizes revolution of the outer rotor, the first biasing means biases the adjustment ring to the side on which pump capacity increases, the pressure receiving portion displaces the adjustment ring toward the side on which pump capacity decreases against the biasing force of the first biasing means by receiving the control pressure, and the biasing force of the first biasing means is set so that displacement of the adjustment ring toward the side on which pump capacity increases is performed in a case where the control pressure exceeds the second control value.

With this configuration, in a variable-capacity oil pump in which the inner rotor meshes with the outer rotor, the required amount of oil can be supplied, by controlling the valve body and the operation of the capacity adjustment mechanism in response to the engine rotational speed through setting of the relationship between the biasing force of the first biasing means for biasing the adjustment ring to the side on which pump capacity increases and the biasing force of the second biasing means for biasing the valve body of the control valve to an open state, and displacing the adjustment ring with control pressure from the control valve.

In a seventh characteristic configuration of the present invention, the rotor has a plurality of movable vanes in a circumferential direction that are projectable and retractable with respect to the outer circumference side of the rotor, the tubular body is a cam ring that changes an amount of projection of the movable vanes through a sliding action with the movable vanes, the pump chamber is partitioned by the movable vanes in the circumferential direction, the capacity adjustment mechanism is capable of changing the pump capacity by moving the cam ring in a radial direction of the cam ring relative to the rotor, the first biasing means biases the cam ring to the side on which pump capacity increases, the pressure receiving portion displaces the cam ring toward the side on which pump capacity decreases against the biasing force of the first biasing means by receiving the control pressure, and the biasing force of the first biasing means is set so that displacement of the cam ring toward the side on which pump capacity increases is performed in a case where the control pressure exceeds the second control value.

With this configuration, in a variable-capacity vane oil pump, the required amount of oil can be supplied, by controlling the valve body and the operation of the capacity adjustment mechanism in response to the engine rotational speed through setting of the relationship between the biasing force of the first biasing means for biasing the cam ring to the side on which pump capacity increases and the biasing force of the second biasing means for biasing the valve body of the control valve to an open state, and displacing the cam ring with control pressure from the control valve.

DESCRIPTION OF EMBODIMENTS

Hereinafter, embodiments of the present invention will be described based on the drawings.

First Embodiment

<Basic Configuration>

Figure 1:
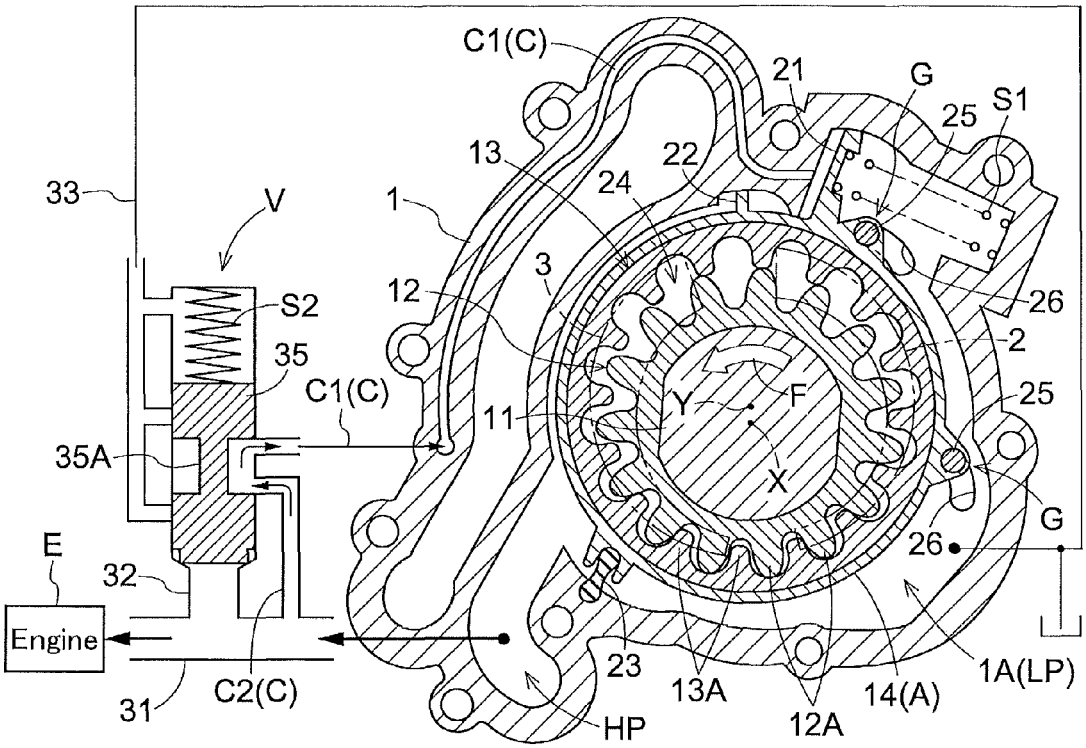
FIG. 1 is a cross-sectional view of an oil pump of a first embodiment in a state where oil pressure is low.

FIG. 1 shows a variable-capacity oil pump that is driven with an engine E of a vehicle so as to supply lubricating oil to the engine E and hydraulic oil of an oil pressure device provided in the engine E (lubricating oil and hydraulic oil will be collectively referred to as oil).

This oil pump is provided with an inner rotor (equivalent to the rotor of the present invention) 12 that is rotationally driven integrally with a drive shaft 11 about a drive rotation axis (equivalent to the rotation axis of the rotor of the present invention) X inside a casing 1, and an outer rotor (equivalent to the tubular body of the present invention) 13 that rotates about a driven rotation axis (equivalent to the tube axis of the present invention) Y that is eccentric to the drive rotation axis X, and is further provided with a capacity adjustment mechanism A that adjusts the pump capacity by causing the outer rotor 13 to revolve around the drive rotation axis X relative to the inner rotor 12, and a control valve V that supplies control oil to the capacity adjustment mechanism A.

The inner rotor 12 serving as a drive rotor is supported by at least one of the casing 1 and the drive shaft 11, and has a plurality of outer teeth 12A. The outer rotor 13 serving as a driven rotor is annular in shape with a plurality of inner teeth 13A that mesh with the outer teeth 12A of the inner rotor 12, and is rotatably supported about the driven rotation axis Y so as to rotate in accordance with rotation of the inner rotor 12.

The outer teeth 12A of the inner rotor 12 are formed in tooth flank form in accordance with a trochoid curve or a cycloid curve. The inner teeth 13A of the outer rotor 13 are set to have one more tooth than the outer teeth 12A of the inner rotor 12, and are formed in tooth flank form to contact the outer teeth 12A of the inner rotor 12 when the outer rotor 13 rotates.

This oil pump is also called a trochoid pump, and a suction port 2 that suctions oil and a discharge port 3 that discharges oil are formed in a wall portion 1A of the casing 1. A pump mechanism is provided that introduces oil into a space (pump chamber) 24 between the outside teeth 12A and the inner teeth 13A from the suction port 2 and pumps oil out from the discharge port 3 under pressure, through the inner rotor 12 being rotationally driven in the direction indicated by arrow F as a result of this configuration.

Naturally, the oil pressure rises since the flow of oil that is discharged from the discharge port 3 increases as the engine rotational speed (rotational speed of engine E) increases.

<Capacity Adjustment Mechanism>

The capacity adjustment mechanism A is provided with an adjustment ring 14 that rotatably supports the outer rotor 13 internally and realizes revolving movement of the outer rotor 13, a guide means G that guides the adjustment ring 14, a pressure receiving portion 21 that is integrally formed with the adjustment ring 14, and a first spring S1 (exemplary first biasing means) that causes a biasing force to act on the adjustment ring 14.

As shown in FIG. 1, the discharge amount of oil is at maximum in a state where the direction of a partitioning portion separating the suction port 2 and the discharge port 3 and the direction of the driven rotation axis Y are aligned relative to the drive rotation axis X.

Figure 8:
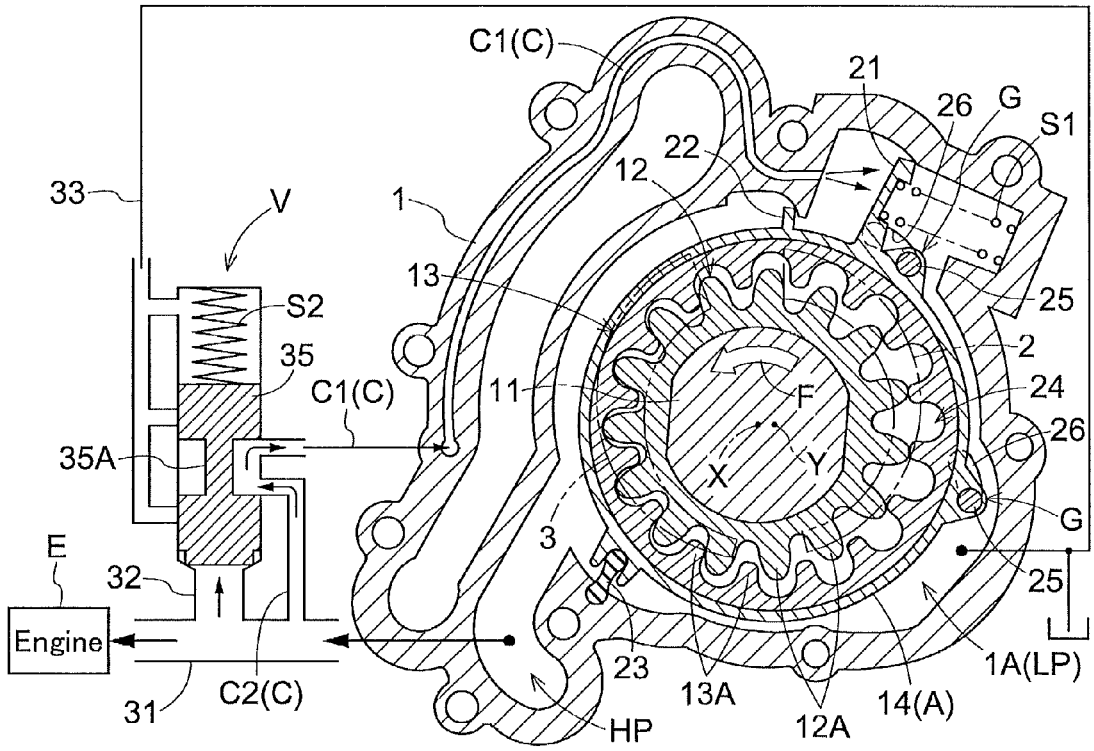
FIG. 8 is a cross-sectional view of the oil pump of the first embodiment in which pump capacity is in a minimum state.

In contrast, as shown in FIG. 8, the discharge amount of oil is at minimum in a state where the direction of the partitioning portion separating the suction port 2 and the discharge port 3 and the direction of the driven rotation axis Y are shifted by a phase of 90 degrees relative to the drive rotation axis X.

In order to adjust the phase of the direction of the partitioning portion and the direction of the driven rotation axis Y relative to the drive rotation axis X, the capacity adjustment mechanism A causes the outer rotor 13 to revolve such that the driven rotation axis Y moves about the drive rotation axis X in a state where the inner teeth 13A mesh with the outside teeth 12A, thereby changing the pump capacity.

Note that since the suction port 2 and the discharge port 3 are disposed on the right and left so as to surround the drive rotation axis X in FIG. 1, the aforementioned partitioning portion is formed in two places, namely, between the positions of upper portions of the suction port 2 and the discharge port 3 and between the positions of lower portions thereof. Accordingly, the discharge amount of oil is at maximum, since the partitioning portions are positioned above and below in FIG. 1, and a line connecting the drive rotation axis X and the driven rotation axis Y is above and below.

The adjustment ring 14 is ring-like in shape with an inner circumferential surface that is coaxial with the driven rotation axis Y so as to rotatably support the outer rotor 13 in an inserted state. The outwardly projecting pressure receiving portion 21 and an auxiliary pressure receiving portion 22 are integrally formed on the outer circumference of the adjustment ring 14. A first control oil passage C1 that causes control pressure to act on the pressure receiving portion 21 is formed in the casing 1, and as a result of control pressure acting on the pressure receiving portion 21 via the first control oil passage C1, the adjustment ring 14 is displaced in a direction in which pump capacity decreases together with the outer rotor 13 against the biasing force of a first spring S1 as the control pressure increases.

The guide means G has two guide pins 25 provided on outer circumferential portions of the adjustment ring 14, and two guide slots 26 for engaging the guide pins 25 that are formed in the wall surface of the casing 1. The two guide slots 26 are formed to have shapes that guide the adjustment ring 14 so as to allow the driven rotation axis Y of the outer rotor 13 to revolve about the drive rotation axis X. The first spring S1 is disposed on the opposite side to the control oil passage C with reference to the pressure receiving portion 21, and causes a biasing force for displacing the adjustment ring 14 to act in a direction in which pump capacity increases.

While the guide means G guides the adjustment ring 14 so as to allow the outer rotor 13 to revolve, the adjustment ring 14 can be caused to perform a rotational motion of rotating about the driven axis in order to suppress the revolving motion of the outer rotor 13.

As will be discussed later, revolution of the outer rotor 13 is prevented and the pump capacity is held in a constant state, in the case where the oil pressure is in the pressure region from the second control value to the third control value in which the engine rotational speed exceeds N2 but is less than N3, by configuring the guide means G so as to cause the adjustment ring 14 to move rotationally about the driven rotation axis Y, thereby enabling the third gradient to be realized.

This capacity adjustment mechanism A is set in the relative positional relationship shown in FIG. 1 where the direction of the partitioning portion that separates the suction port 2 and the discharge port 3 and direction of the driven rotation axis Y are aligned relative to the drive rotation axis X in the case where the pump capacity is at maximum, and is set in the relative positional relationship shown in FIG. 8 where the direction of the partitioning portion that separates the suction port 2 and the discharge port 3 and direction of the driven rotation axis Y are shifted at a phase of 90 degrees relative to the drive rotation axis X in the case where the pump capacity is at minimum. In the case where pump capacity is changed between the maximum value and the minimum value, the driven rotation axis Y thus revolves 90 degrees about the drive rotation axis X.

The capacity adjustment mechanism A sets the amount of revolution of the outer rotor 13 in a state where the inner teeth 13A of the outer rotor 13 mesh with the outer teeth 12A of the inner rotor 12 by adjusting the pressure of the control oil that acts on the pressure receiving portion 21 via the control oil passage C, thereby realizing a change in pump capacity.

Although not shown in the drawings, the casing 1 has a structure in which a wall body that is oriented parallel to the wall portion 1A is disposed in a position opposing the wall portion 1A where the suction port 2 and the discharge port 3 are formed. The wall body is disposed in a position where the inner rotor 12, the outer rotor 13 and adjustment ring 14 are all sandwiched between the wall portion 1A and the wall body as a result of this configuration. Note that the drive shaft 11 is provided in a state of passing through at least one of the wall portion 1A and the wall body.

As shown in FIG. 1, a low pressure space LP that is in communication with the suction port 2 is formed in a site where the first spring S1 is disposed on the outer circumference of the adjustment ring 14, and a pressurized space HP (exemplary oil pressure action space) that is in communication with the discharge port 3 is formed on the opposite side thereto. A sealing vane 23 is provided between the outer circumference of the adjustment ring 14 and the inner surface of the casing 1, and the low pressure space LP and the pressurized space HP are separated by the sealing vane 23 and the aforementioned auxiliary pressure receiving portion 22. Note that low pressure space LP is at atmospheric pressure or lower.

<Control Valve>

An oil supply passage 31 for supplying oil from the discharge port 3 (from the pressurized space HP) to the engine E is formed, and the control valve V is provided in a position on which the oil pressure from the oil supply passage 31 acts. Although the control valve V is provided integrally with the casing 1, the control valve V may be provided separately from the casing 1.

The control valve V is provided with a valve body 35 that moves linearly within a cylindrical space, and a second spring S2 (exemplary second biasing means) that causes a biasing force to act on the valve body 35 in a direction against the oil pressure. The valve body 35 has a small diameter portion 35A formed in a longitudinally central section thereof, and a hydraulic oil passage 32 for allowing oil pressure from the oil supply passage 31 to act on the valve body 35 is formed. Also, a second control oil passage C2 for allowing oil pressure from oil supply passage 31 to act on an intermediate section of the valve body 35 is formed, and this second control oil passage C2 is in communication with the aforementioned first control oil passage C1 across the control valve V. Furthermore, an outflow oil passage 33 for pumping oil that flows out from the control valve V to the low pressure space LP (discharged oil may be pumped to a drain port of the oil passage system) is formed.

The first control oil passage C1 and the second control oil passage C2 together constitute the control oil passage C, and the control pressure (oil pressure) acting on the pressure receiving portion 21 via this control oil passage C is controlled with the control valve V.

This control valve V has a function of converting pump pressure (oil pressure from discharge port 3) into control pressure and causing this control pressure to act on the pressure receiving portion 21 of the adjustment ring 14, through the valve body 35 operating against the biasing force of the second spring S2 due to the action of the pump pressure and blocking the control oil passage C, and through adjusting the degree of opening of the control oil passage C.

<Modes of Operation>

Figure 7:
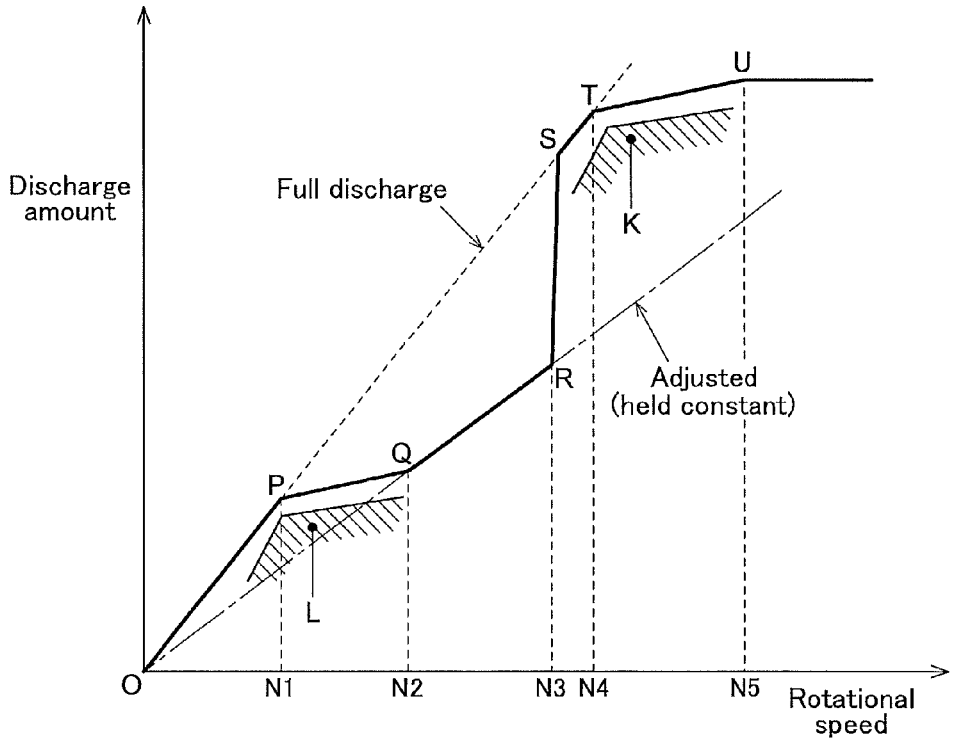
FIG. 7 is a graph of oil discharge amount to engine rotational speed.

In this oil pump, the capacity adjustment mechanism A is controlled such that, in the case where the engine rotational speed (rotational speed of engine E) increases from point O to N1, N2, N3, N4 and up to N5, as shown in FIG. 7, the discharge amount of oil increases from O to P, Q, R, S, T and U. Also, the oil pressure in a state where the engine rotational speed is N1 is called the first control value, and the oil pressures of the discharge port 3 (pressurized space HP) in states where the engine rotational speed is from N2 to N5 are accordingly called the second to fifth control values.

The amount of oil required for lubrication of the engine E and for control by a valve timing control device is generally set even in a state where the engine rotational speed is low. Accordingly, in the case where the engine rotational speed increases to exceed a predetermined value, it is not necessary to increase the amount of oil in proportion to the engine rotational speed. However, if the engine rotational speed rises to a very high value, a large amount of oil is needed in order to cool the engine E.

For this reason, as shown in FIG. 7, in the case where the engine rotational speed is low, the discharge amount of oil is set to a large value, and in the case where the engine rotational speed exceeds N1, pointless supply of oil is suppressed by reducing the ratio of oil discharge amount to increase in engine rotational speed. Then, in the case where the engine rotational speed exceeds N3, oil is supplied to all parts of the engine E that are driven at high speed, and the discharge amount of oil is accordingly increased in order to promote cooling of the engine E.

Since pump capacity of the oil pump can be adjusted as aforementioned, in FIG. 7 the change in discharge amount relative to engine rotational speed when the pump capacity is set to maximum is shown with a broken line as "full discharge" (O-P, S-T), and a state where the pump capacity is a certain capacity that is less than the maximum is shown with a dashed-dotted line as "adjusted" (Q-R). Also, regions denoted by P-Q and T-U indicate the change in discharge amount when the pump capacity is changed continuously by causing the driven rotation axis Y of the outer rotor 13 to revolve about the drive rotation axis X. A region denoted by L in FIG. 7 represents the amount of oil required by the aforementioned valve timing control device, and a region denoted by K represents the amount of oil required as a piston cooling jet.

In other words, in a low speed state in which the engine rotational speed is from O to less than N1, the capacity adjustment mechanism A sets the pump capacity to maximum and supplies the minimum amount (O-P) of oil required for lubrication of the engine E and for the valve timing control device. Subsequently, in a state where the engine rotational speed is from N1 to less than N2, an amount (P-Q) of oil from which unnecessary supply has been suppressed is supplied by the capacity adjustment mechanism A controlling the pump capacity in the reduction direction.

Next, in a state where the engine rotational speed is from N2 to less than N3, the capacity adjustment mechanism A obtains an amount (Q-R) of oil that increases slowly by holding the pump capacity in a reduced state. Next, in the case where the engine rotational speed reaches N3, an amount (R-S) of oil that increases rapidly is obtained by the capacity adjustment mechanism A setting the pump capacity to maximum. Next, in a high speed state in which the engine rotational speed is from N3 to less than N4, an amount (S-T) of oil that is directly proportional to the engine rotational speed is supplied by the capacity adjustment mechanism A maintaining the pump capacity at maximum.

Then, in a state where the engine rotational speed is from N4 to less than N5, a suppressed amount (T-U) of oil is supplied by the capacity adjustment mechanism A again controlling the pump capacity in the reduction direction. Furthermore, in the case where the engine rotational speed exceeds N5, the control valve V reaches a relief state, and a rise in oil pressure is suppressed while at the same time maintaining a set amount (U) of oil. Modes of operation of the capacity adjustment mechanism A when the amount of oil is controlled, and modes of control by the control valve V will thus be described below.

<O-N1>

When engine rotational speed is from O to less N1, the oil pressure is less than the first control value, and, as shown in FIG. 1, the control valve V maintains the control oil passage C in a fully open state via the small diameter portion 35A of the valve body 35. At the same time, the capacity adjustment mechanism A maintains the pump capacity at maximum by setting the biasing force of the first spring S1 of the capacity adjustment mechanism A so as to resist the control pressure that is supplied from the control oil passage C. The control valve V does not necessarily need to be the fully open state in this control, and need only be in an open state.

An amount (O-P) of oil that is directly proportional to the engine rotational speed is thereby supplied to the engine E in a state where the pump capacity is maintained at maximum. For (O-P) the gradient of the discharge amount of oil accompanying an increase in engine rotational speed corresponds to a first gradient.

In order to realize this control, the biasing force of the second spring S2 is set such that the valve body 35 of the control valve V maintains the position shown in FIG. 1 when the oil pressure is less than the first control value (less than the second control value to be precise as described later), and the biasing force of the first spring S1 is set such that the pressure receiving portion 21 is maintained in the position shown in FIG. 1.

Because the pump capacity is thus maintained at maximum by the capacity adjustment mechanism A in the pressure region in which oil pressure is less than the first control value (engine rotational speed is less than N1), the amount of oil required for lubrication of the engine E can be supplied to the engine E, even in a state where the engine rotational speed is low.

<N1-N2>

Figure 2:
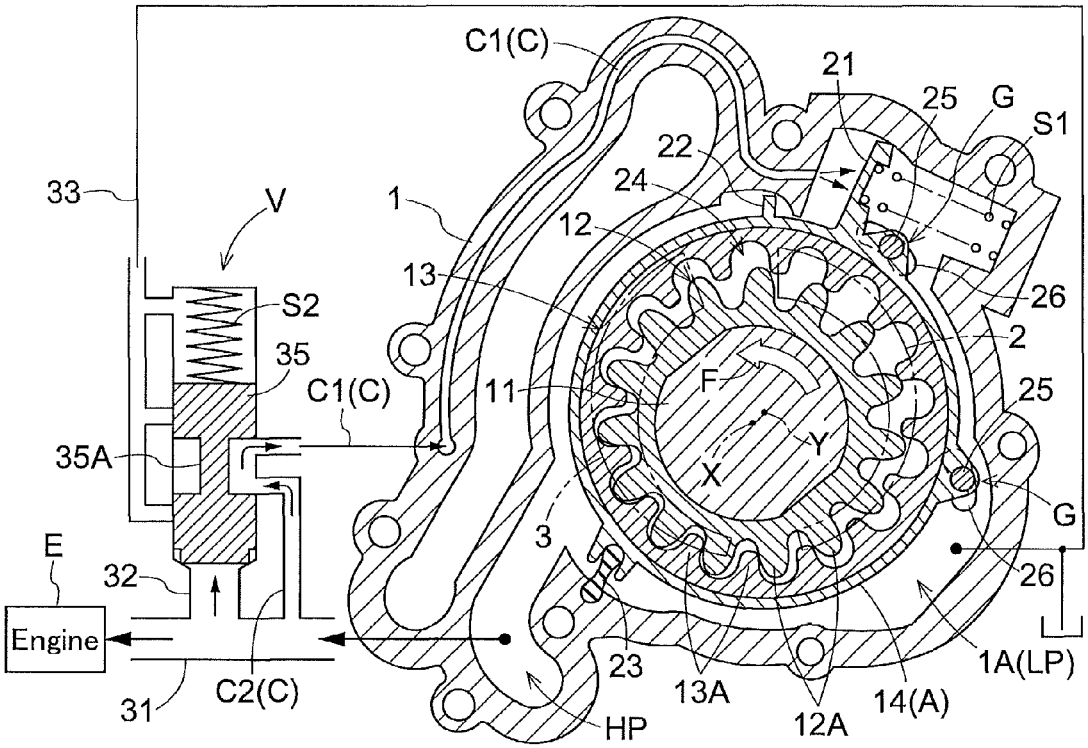
FIG. 2 is a cross-sectional view of the oil pump of the first embodiment in which pump capacity is in a reduced state.

Next, when the engine rotational speed is from N1 to less than N2, the adjustment ring 14 is displaced toward the side on which pump capacity decreases integrally with the pressure receiving portion 21 by the control pressure supplied from the control oil passage C, while the control valve V maintains the control oil passage C in an open state, as shown in FIG. 2 at the timing at which the engine rotational speed exceeds N1 (timing at which oil pressure exceeds first control value). The outer rotor 13 revolves in the direction in which pump capacity decreases together with this displacement, and the pump capacity continuously decreases.

However, the rotational speed of the oil pump increases following an increase in engine rotational speed from N1 to N2. As a result of these opposing changes being combined, the discharge amount of oil will increase slowly following an increase in the rotational speed of the engine E. That is, a substantially constant amount (P-Q) of oil is supplied to the engine E. For (P-Q) the gradient of the discharge amount of oil accompanying an increase in engine rotational speed corresponds to a second gradient, with this second gradient being less than the first gradient.

To realize this control, the biasing force of the second spring S2 is set such that the valve body 35 of the control valve V maintains the position shown in FIG. 2 in the case where oil pressure is less than the second control value, and the biasing force of the first spring S1 is set such that the adjustment ring 14 operates to the position shown in FIG. 2 integrally with the pressure receiving portion 21. Also, the guide means G may be set such that the adjustment ring 14 moves rotationally on its own axis between the position of Q and the position of R.

Because the oil capacity in the pressure region in which oil pressure exceeds the first control value (engine rotational speed exceeds N1) but is less than the second control value (engine rotational speed is less than N2) is continuously reduced by the capacity adjustment mechanism A, an amount of oil from which unnecessary supply has been suppressed can thus be supplied to the engine E.

<N2-N3>

Figure 3:
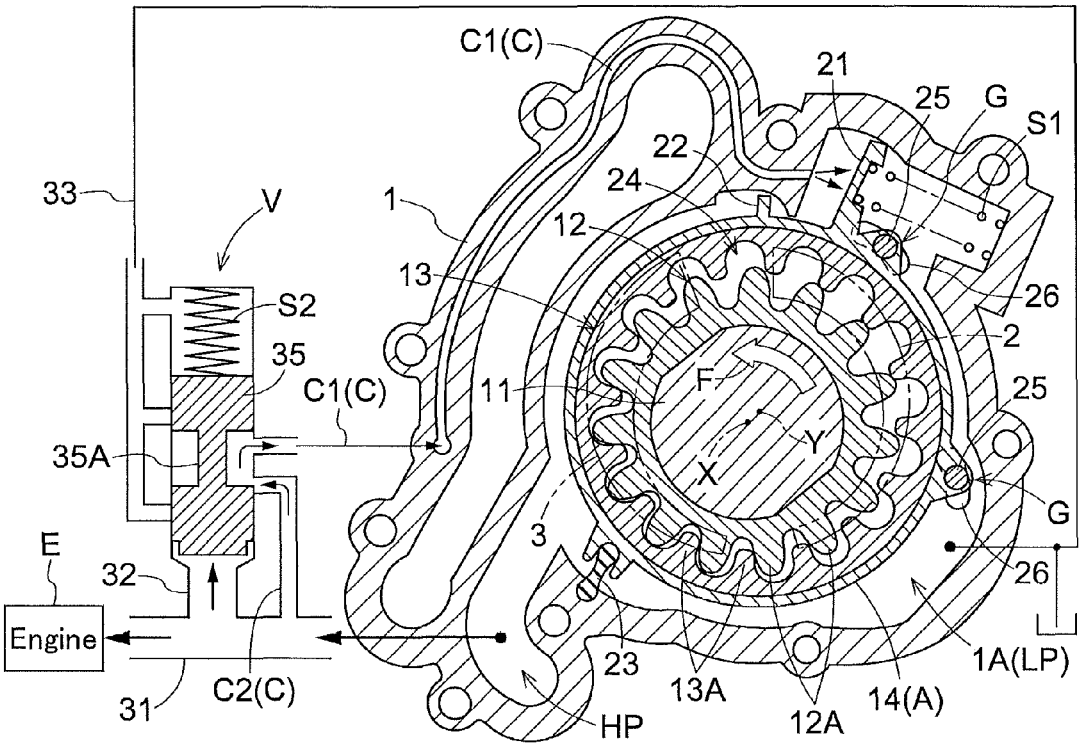
FIG. 3 is a cross-sectional view of the oil pump of the first embodiment in a state where a control oil passage is narrowed.

Next, when the engine rotational speed is from N2 to less than N3, a state where the section communicating from the first control oil passage C1 to the small diameter portion 35A of the control valve V is narrowed (cross-section area of control oil passage C is reduced) is reached, as shown in FIG. 3 at the timing at which the engine rotational speed exceeds N2 (timing at which the oil pressure exceeds the second control value). The control pressure thereby decreases as the engine rotational speed increases, and the biasing force of the first spring S1 acts to increases the displacement amount of the adjustment ring 14 toward the side on which pump capacity increases following the increase in engine rotational speed. On the other hand, the oil pressure acting on the auxiliary pressure receiving portion 22 increases as the engine rotational speed increases, thereby acting to increase the displacement amount of the adjustment ring 14 toward the side on which pump capacity decreases.

At this time, when the biasing force of the first spring S1 is set lower than the oil pressure acting on the auxiliary pressure receiving portion 22, the adjustment ring 14 moves toward the side on which pump capacity decreases as a result.

Incidentally, in the case where Q-R has discharge characteristics that passes through the origin O as shown in FIG. 7, revolution of the outer rotor 13 can be stopped (i.e., only rotates on own axis) when the adjustment ring 14 moves toward the side on which pump capacity decreases, by setting the movement locus of the adjustment ring 14.

An amount (Q-R) of oil that is proportional to the engine rotational speed is thus supplied to the engine E in a state where the pump capacity is held constant. For (Q-R) the gradient of the discharge amount of oil accompanying an increase in engine rotational speed corresponds to a third gradient, with this third gradient being greater than the second gradient. In particular, in this region N2-N3, there is hardly any increase in the pump capacity as a result of the adjustment ring 14 being caused to rotate on its own axis as aforementioned or being caused to move in a manner includes elements of both rotation and revolution, and a rapid increase in discharge amount can be suppressed by increasing the discharge amount by only an amount of oil corresponding to the increase in engine rotation.

To realize this control, the biasing force of the second spring S2 is set such that a state is reached where the valve body 35 of the control valve V narrows the control oil passage C in the case where the oil pressure exceeds the second control value, and further narrows the control oil passage C until the oil pressure reaches a third control pressure.

<N3-N4>

Figure 4:
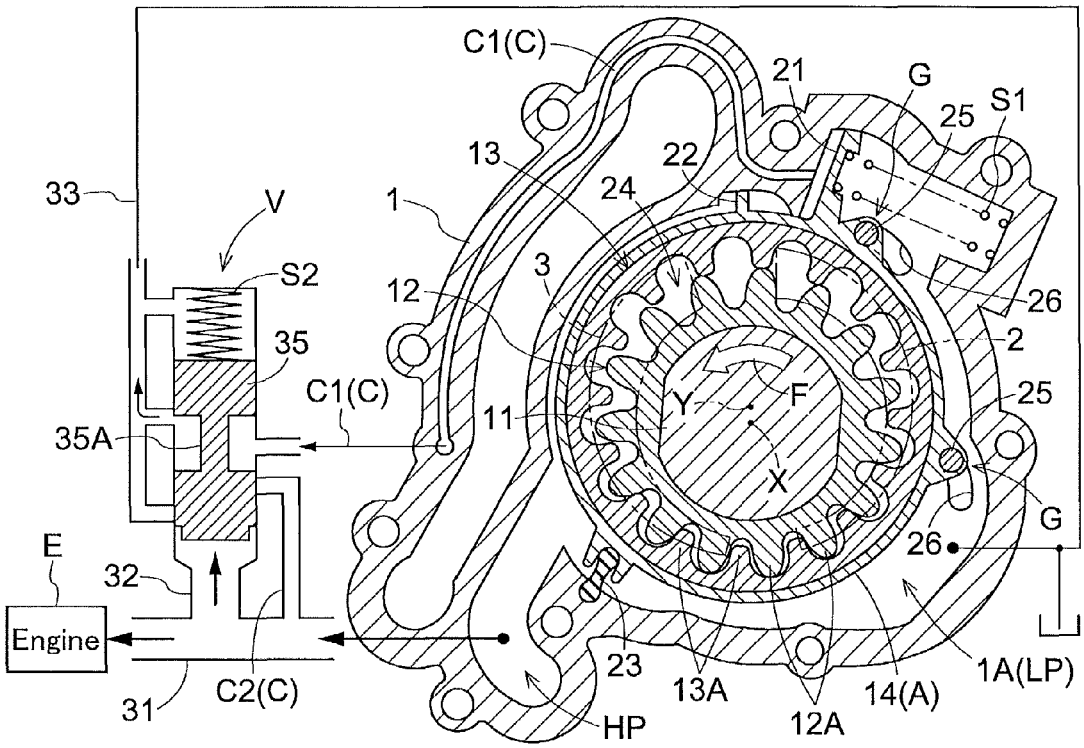
FIG. 4 is a cross-sectional view of the oil pump of the first embodiment in a state where control pressure has dropped sharply.

Next, when the engine rotational speed is from N3 to less than N4, the second control oil passage C2 is blocked by the control valve V, as shown in FIG. 4 at the timing at which the engine rotational speed exceeds N3 (timing at which oil pressure exceeds third control value). At the same time, the first control oil passage C1 is connected to the outflow oil passage 33 by the control valve V, and the control pressure acting on the pressure receiving portion 21 drops sharply. As a result, the adjustment ring 14 is displaced to the operation limit on the side on which pump capacity increases integrally with the pressure receiving portion 21 by the biasing force of the first spring S1. The outer rotor 13 revolves in the direction in which pump capacity increases together with this displacement, and the pump capacity increases to maximum. An amount (S-T) of oil that is directly proportional to the engine rotational speed is thus supplied to the engine E in a state where the pump capacity is maintained at maximum.

In order to realize this control, the biasing force of the second spring S2 is set such that the valve body 35 of the control valve V maintains the position shown in FIG. 2 at the timing at which the oil pressure exceeds the third control value.

<N4-N5>

Figure 5:
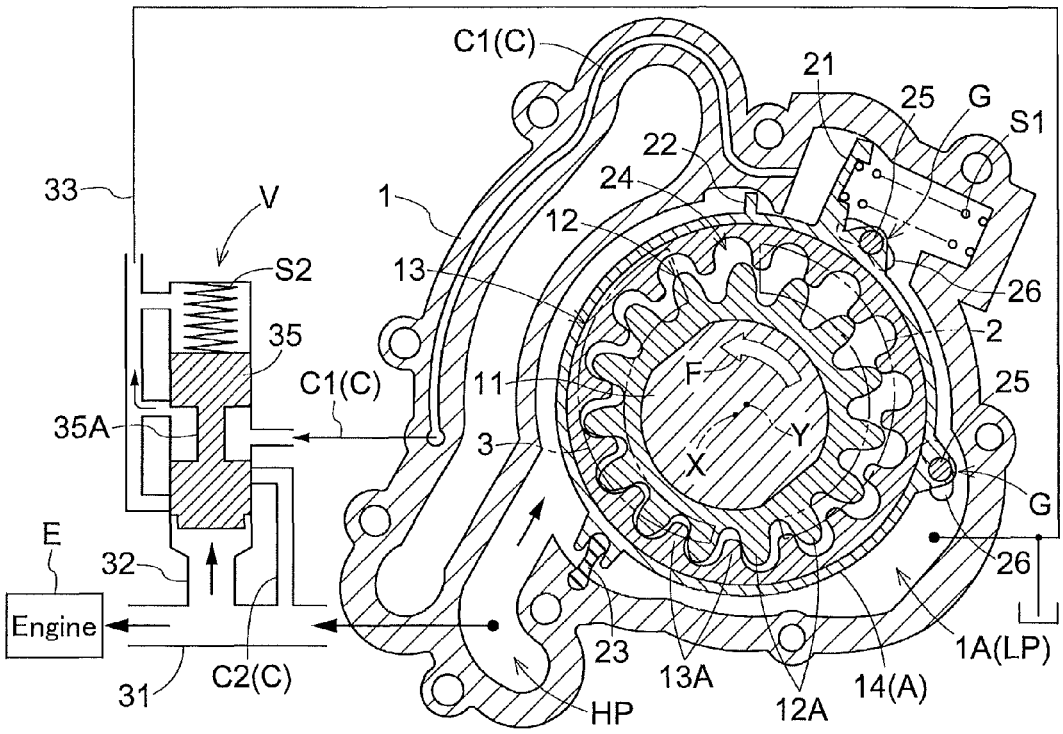
FIG. 5 is a cross-sectional view of the oil pump of the first embodiment in a state where pump capacity has been operated to the reduction side by the oil pressure of a pressurized space.

Next, when the engine rotational speed is from N4 to less than N5, the blocked state of the second control oil passage C2 by the control valve V is maintained, as shown in FIG. 5 at the timing at which engine rotational speed exceeds N4 (timing at which oil pressure exceeds fourth control value). In this state, oil pressure acts on the auxiliary pressure receiving portion 22 and the outer circumference of the adjustment ring 14 from the pressurized space HP (oil pressure action space), and the adjustment ring 14 is displaced to the operation limit on the side on which pump capacity decreases. The inner rotor 12 revolves in the direction in which pump capacity decreases as a result of this displacement, and the pump capacity decreases continuously. An amount (T-U) of oil that is substantially constant relative to the engine rotational speed is thereby supplied to the engine E in a state where the pump capacity decreases continuously.

In order to realize this control, the biasing force of the second spring S2 is set such that the valve body 35 of the control valve V maintains the blocked position shown in FIG. 5 in the case where the oil pressure exceeds the fourth control value, and the biasing force of the first spring S1 is set such that the adjustment ring 14 moves to the position shown in FIG. 5 as a result of the oil pressure acting directly to the adjustment ring 14.

<N5 and Above>

Figure 6:
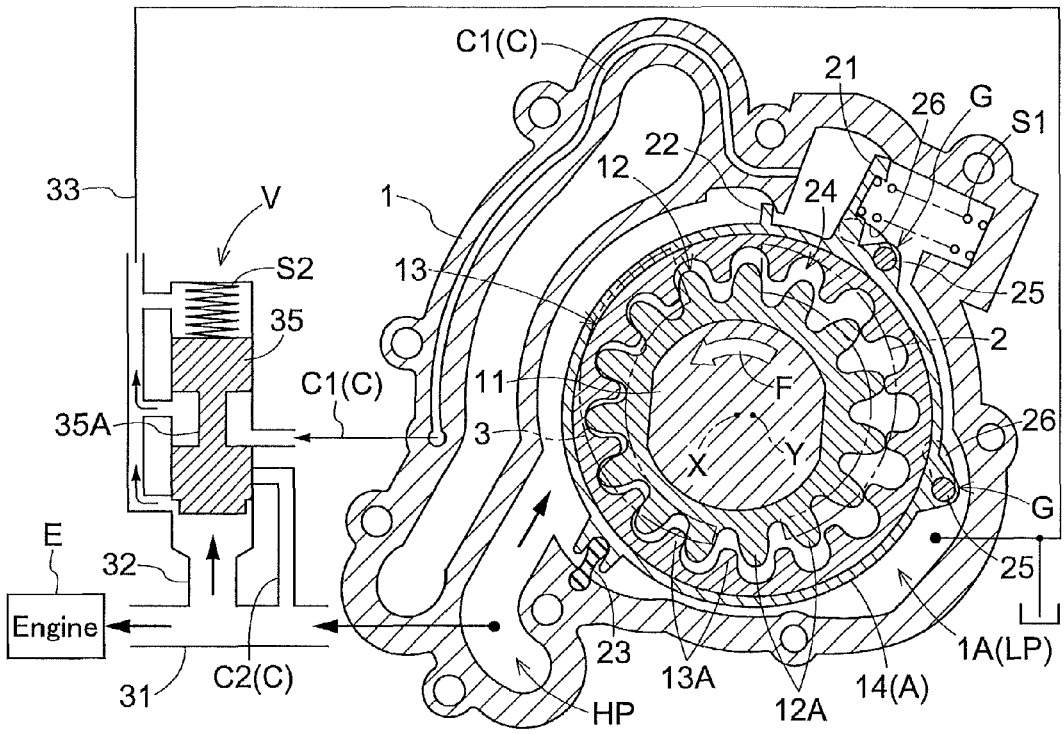
FIG. 6 is a cross-sectional view of the oil pump of the first embodiment in which a control valve is in a relief state.

Next, the oil in the hydraulic oil passage 32 is allowed to flow out through the outflow oil passage 33 by the control valve V, as shown in FIG. 6 at the timing at which the engine rotational speed exceeds N5 (timing at which oil pressure exceeds fifth control value), and a rise in oil pressure is suppressed. Note that the pump capacity is also maintained in the reduced state by the oil pressure acting on the outer circumference of the adjustment ring 14 from the pressurized space HP in a situation where the control valve V thus reaches the relief state.

In order to realize this control, the biasing force of the second spring S2 is set such that the valve body 35 of the control valve V reaches the relief state as shown in FIG. 6, in the case where the oil pressure exceeds the fifth control value.

<Actions and Effects of the Embodiment>

With the oil pump of the present invention, adjustment of pump capacity is thus realized without being affected by the viscosity of the oil, even in the case of the viscosity being high, by combining a variable-capacity pump having the inner rotor 12 and the outer rotor 13 with the control valve V that operates mechanically in order to adjust the capacity of the variable-capacity pump. Also, the oil pump realizes stepless changes in pump capacity through the revolution of the outer rotor 13, while maintaining a state where the outer teeth 12A of the inner rotor 12 mesh with the inner teeth 13A of the outer rotor 13.

This oil pump realizes adjustment of pump capacity through setting of the relationship between the biasing force of the first spring S1 that biases the adjustment ring 14 to the side on which pump capacity increases and the biasing force of the second spring S2 that biases the valve body 35 of the control valve V. As a result of this configuration, when the engine rotational speed changes in the regions from N1 to N4, the required amount of oil is supplied to the engine E even in the case where the engine rotational speed is low, unnecessary supply of oil is eliminated by suppressing an increase in oil in the case where the engine rotational speed increases, and sufficient supply of oil required for cooling is also possible in the case where the engine rotational speed increases to near the upper limit.

Furthermore, in the case where the engine rotational speed exceeds N5, supply of excess oil to the oil pump and the engine E is suppressed to prevent damage to the oil pump, the lubricating system of the engine E or the like, by setting the control valve V to the relief state and relieving oil pressure.

Second Embodiment

Figure 9:
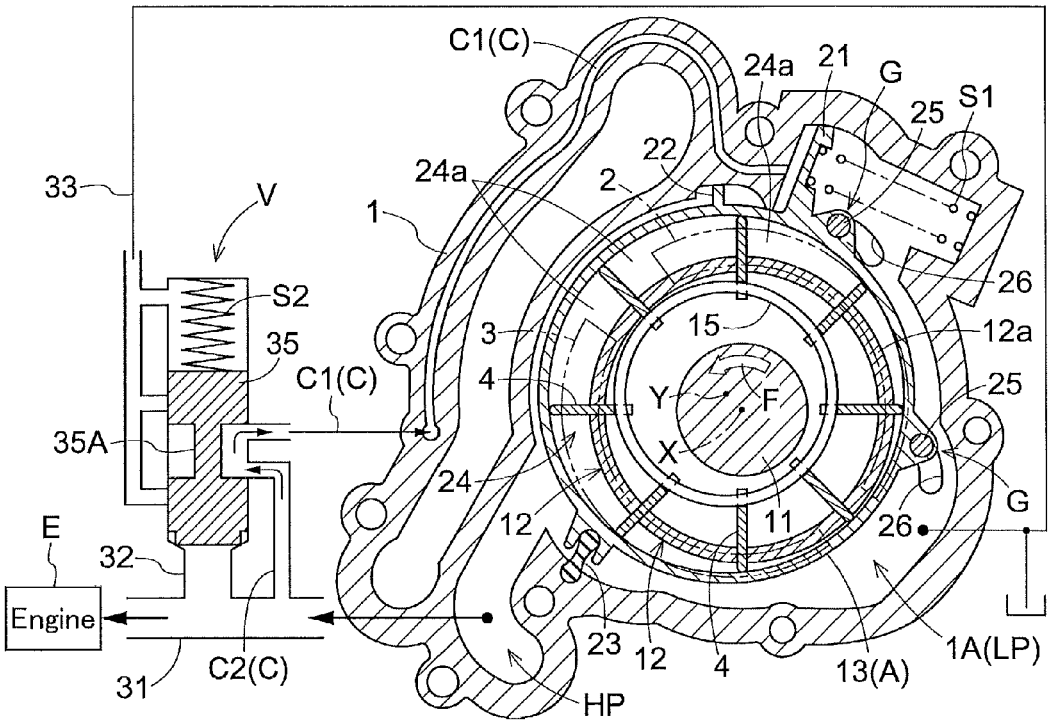
FIG. 9 is a cross-sectional view of an oil pump of a second embodiment in a state where oil pressure is low.
Figure 10:
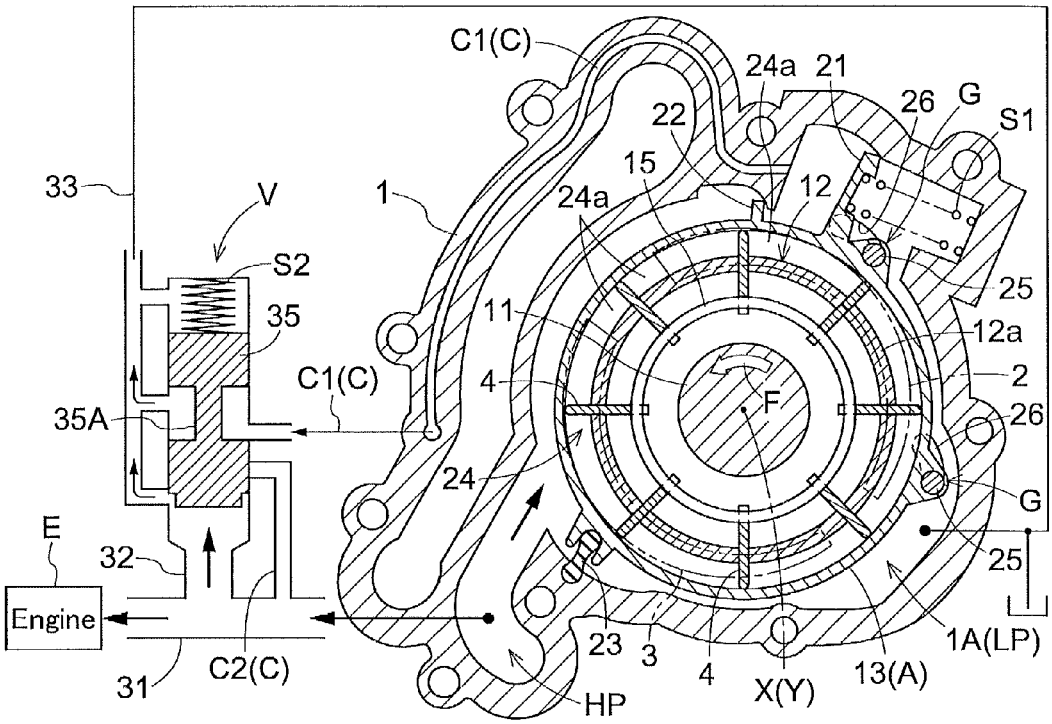
FIG. 10 is a cross-sectional view of the oil pump of the second embodiment in which pump capacity is in a minimum state.

FIG. 9 and FIG. 10 show another embodiment of the oil pump according to the present invention.

The oil pump of the present embodiment is constituted by a variable-capacity vane oil pump.

This oil pump is provided with a rotor 12 having a plurality of movable vanes 4 in the circumferential direction that are biased so as to move projectably and retractably with respect to the outer circumferential side of the rotor, and a cam ring (equivalent to tubular body of the present invention) 13 that changes the amount of projection of the movable vanes 4 through a sliding action with the movable vanes 4.

The rotor 12 is coaxially provided with a cylindrical outer circumferential tube portion 12*a* that is rotationally driven integrally with a drive shaft 11 around a rotation axis X. On the inner circumferential side of the outer circumferential tube portion 12*a* is mounted a supporting ring 15 that supports the base end side of each movable vane 4.

The tip section of each movable vane 4 is mounted so as to be slidable in the radial direction of the rotor 12 with respect to the outer circumferential tube portion 12*a*, the base end side is supported by the supporting ring 15 mounted on the inner circumferential side of the outer circumferential tube portion 12*a*, and each movable vane 4 is biased by the centrifugal force accompanying rotation of the rotor 12 so as to project toward the rotor outer circumference side. The cam ring 13 is formed in a cylindrical shape in which the inner circumferential surface on which the tip sections of the movable vanes 4 slide is formed with a cylindrical surface.

A pump chamber 24 is formed between the outer circumference side of the outer circumferential tube portion 12*a* and the inner circumferential side of the cam ring 13, and is compartmentalized in the circumferential direction into a plurality of pump chamber sections 24*a* by the movable vanes 4. A pump mechanism is provided that, by rotationally driving the rotor 12 in the direction shown by arrow F, introduces oil into the pump chamber sections 24*a* from the suction port 2 following an increase in the capacity of the pump chamber sections 24*a*, and pumps oil in the pump chamber sections 24*a* out from the discharge port 3 following a reduction in the capacity of the pump chamber sections 24*a*.

A capacity adjustment mechanism A changes the pump capacity by causing the cam ring 13 to oscillate in the radial direction of the cam ring 13 relative to the rotor 12 with the sealing vane 23 as the fulcrum, instead of providing the adjustment ring 14 in the first embodiment.

The pressure receiving portion 21 and the auxiliary pressure receiving portion 22 are thus formed integrally with the cam ring 13, the sealing vane 23 is provided between the outer circumference of the cam ring 13, and the inner surface of the casing 1, the guide means G has the two guide pins 25 provided on outer circumferential portions of the cam ring 13, and the first spring S1 is provided so as to bias the cam ring 13 to the side on which pump capacity increases.

FIG. 9 shows a state where the cam ring axis Y has moved to the most eccentric position from the rotation axis X and the discharge amount of oil is at maximum, and FIG. 10 shows a state where the cam ring axis Y has moved to a coaxial position with the rotation axis X and the discharge amount of oil is at minimum.

The pressure receiving portion 21 is provided so as to displace the cam ring 13 to the side on which pump capacity decreases against the biasing force of the first spring S1 by receiving control pressure, and the biasing force of the first spring S1 is set so as to displace the cam ring 13 to the side on which pump capacity increases in the case where control pressure exceeds the second control value.

Because the other configurations and the modes of operation are similar to the first embodiment, description thereof is omitted.

INDUSTRIAL APPLICABILITY

The present invention can be used in all oil pumps that supply a required amount of oil to an engine.

The invention claimed is:

1. An oil pump comprising:

a rotor that is rotationally driven by an engine;

a tubular body that forms a pump chamber between the tubular body and an outer circumference side of the rotor;

a casing that houses the rotor and the tubular body;

a suction port and a discharge port that are formed in the casing;

a pump mechanism that causes oil suctioned into the pump chamber from the suction port to be discharged from the discharge port following rotation of the rotor;

a capacity adjustment mechanism that changes a pump capacity by moving the tubular body in a tube radial direction relative to the rotor;

a control valve that converts oil pressure from the discharge port into control pressure; and a control oil passage that is capable of moving the tubular body in the tube radial direction by causing the control pressure from the control valve to act on the capacity adjustment mechanism, wherein the capacity adjustment mechanism has a configuration that moves the tubular body in a direction in which pump capacity decreases, as the control pressure increases, the control valve maintains the control oil passage in an open state, in a pressure region in which the oil pressure is less than a first control value and in a pressure region in which the oil pressure reaches a second control value that exceeds the first control value, and the capacity adjustment mechanism, in a case where the control pressure is less than the first control value, increases an oil discharge amount at a first gradient following an increase in engine rotational speed by setting the pump capacity to maximum, and, in a case where the control pressure exceeds the first control value, increases the oil discharge amount at a second gradient that is less than the first gradient following an increase in engine rotational speed in a state where the pump capacity is reduced by moving the tubular body in the direction in which pump capacity decreases.

2. The oil pump according to claim 1, wherein the control valve, in a case where the oil pressure rises in a pressure region from the second control value up to a third control value that exceeds the second control value, operates to decrease the control pressure by narrowing the control oil passage as the oil pressure rises, and the capacity adjustment mechanism decreases the reduction in pump capacity by reducing or stopping movement of the tubular body in the direction in which pump capacity decreases, and increases the oil discharge amount at a third gradient that is greater than the second gradient following an increase in engine rotational speed.

3. The oil pump according to claim 2, wherein the control valve, in a case where the oil pressure rises to a value exceeding the third control value, operates to a position that blocks a site of the control oil passage on which the oil pressure acts, and that brings a site of the control oil passage on the capacity adjustment mechanism side into communication with a low pressure side, and the capacity adjustment mechanism increases the pump capacity by moving the tubular body in a direction in which pump capacity increases, following a decrease in the control pressure.

4. The oil pump according to claim 1, wherein the capacity adjustment mechanism has a first biasing means for biasing the tubular body to a side on which pump capacity increases, and a pressure receiving portion that moves the tubular body toward a side on which pump capacity decreases against a biasing force of the first biasing means by receiving the control pressure, the control valve has a valve body that is displaced by the oil pressure that acts from the discharge port, and a second biasing means for causing a biasing force to act on the valve body in a direction against the oil pressure, and the biasing force of the second biasing means is set such that the valve body maintains the control oil passage in an open state in a case where the oil pressure is less than the second control value, and the biasing force of the first biasing means is set such that the tubular body moves toward the side on which pump capacity increases in a case where the control pressure exceeds the second control value.

5. The oil pump according to claim 4, wherein an oil pressure action space in which the oil pressure from the discharge port acts on an outer circumferential portion of the tubular body is formed inside the casing, and in a region in which the oil pressure exceeds the third control value, the biasing force of the first biasing means is set such that the tubular body is moved toward the side on which pump capacity decreases by the oil pressure that acts on the outer circumferential portion of the tubular body from the oil pressure action space.

6. The oil pump according to claim 4, wherein the rotor is an inner rotor that has a plurality of outer teeth, the tubular body is an outer rotor that has an annular shape with a plurality of inner teeth that mesh with the outer teeth, and that is rotatable around a tube axis that is eccentric relative to a rotation axis of the inner rotor, the pump chamber is formed between the inner teeth and the outer teeth, the capacity adjustment mechanism is capable of changing the pump capacity by causing the outer rotor to revolve about the rotation axis in a state where the inner teeth mesh with the outer teeth, the capacity adjustment mechanism has an adjustment ring that rotatably supports the outer rotor, and realizes revolution of the outer rotor, the first biasing means biases the adjustment ring to the side on which pump capacity increases, the pressure receiving portion displaces the adjustment ring toward the side on which pump capacity decreases against the biasing force of the first biasing means by receiving the control pressure, and the biasing force of the first biasing means is set so that displacement of the adjustment ring toward the side on which pump capacity increases is performed in a case where the control pressure exceeds the second control value.

7. The oil pump according to claim 4, wherein the rotor has a plurality of movable vanes in a circumferential direction that are projectable and retractable with respect to the outer circumference side of the rotor, the tubular body is a cam ring that changes an amount of projection of the movable vanes through a sliding action with the movable vanes, the pump chamber is partitioned by the movable vanes in the circumferential direction, the capacity adjustment mechanism is capable of changing the pump capacity by moving the cam ring in a radial direction of the cam ring relative to the rotor, the first biasing means biases the cam ring to the side on which pump capacity increases, the pressure receiving portion displaces the cam ring toward the side on which pump capacity decreases against the biasing force of the first biasing means by receiving the control pressure, and the biasing force of the first biasing means is set so that displacement of the cam ring toward the side on which pump capacity increases is performed in a case where the control pressure exceeds the second control value.

* * * * *